US007281829B2

(12) United States Patent
Suzuki

(10) Patent No.: US 7,281,829 B2
(45) Date of Patent: Oct. 16, 2007

(54) VEHICLE HEADLIGHT

(75) Inventor: Eiji Suzuki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 173 days.

(21) Appl. No.: 11/143,965

(22) Filed: Jun. 3, 2005

(65) Prior Publication Data

US 2005/0270792 A1 Dec. 8, 2005

(30) Foreign Application Priority Data

Jun. 4, 2004 (JP) ..... 2004-167156

(51) Int. Cl.
*F21V 7/00* (2006.01)

(52) U.S. Cl. ..... 362/517; 362/301; 362/346; 362/518

(58) Field of Classification Search ..... 362/301, 362/346, 518, 517, 300
See application file for complete search history.

(56) References Cited

U.S. PATENT DOCUMENTS 4,918,580 A * 4/1990 Nino ..... 362/539
6,059,435 A 5/2000 Hamm et al.
6,494,603 B1 12/2002 Takada
2003/0090906 A1 * 5/2003 Hayakawa ..... 362/517

FOREIGN PATENT DOCUMENTS

| | | |
|---|---|---|
| EP | 0 591 566 A1 | 4/1994 |
| EP | 1 288 069 A2 | 3/2003 |
| JP | 63-125302 U | 8/1988 |

* cited by examiner

*Primary Examiner*—Ali Alavi
*Assistant Examiner*—Jason Moon Han
(74) *Attorney, Agent, or Firm*—Foley & Lardner LLP

(57) ABSTRACT

A main reflector has a main reflection-surface based on an ellipsoid of revolution. A light source is arranged substantially at a first focal-point of the main reflection-surface. A shade arranged substantially at a second focal-point of the main reflection-surface cuts off a part of reflected light from the main reflection-surface to form a predetermined main light-distribution-pattern. A projection lens projects the main light-distribution-pattern ahead of a vehicle. A sub reflector reflects a light from the light source to irradiate the light on outer sides of the main light-distribution-pattern as a predetermined sub-light distribution pattern.

11 Claims, 6 Drawing Sheets

VEHICLE HEADLIGHT

CROSS-REFERENCE TO RELATED APPLICATIONS

The present document incorporates by reference the entire contents of Japanese priority document, 2004-167156 filed in Japan on Jun. 4, 2004.

BACKGROUND OF THE INVENTION

1. Field of the Invention

The present invention relates to a vehicle headlight including a headlamp or a fog lamp of a projector type that irradiates light ahead of a vehicle to shine a light on a road surface and the like ahead of the vehicle, and more particularly, to a vehicle headlight that can light the left and the right sides near the vehicle over a wide area.

2. Description of the Related Art

As a vehicle headlight including a headlamp or a fog lamp of a projector type that irradiates light to the front of a vehicle and lights a road surface and the like in front of the vehicle, for example, there is a vehicle headlight described in Japanese Utility Model Publication No. S63-125302. The vehicle headlight described in Japanese Utility Model Publication No. S63-125302 is explained below. The vehicle headlight includes a reflector of an elliptical shape, a light source arranged at a first focal-point of this reflector, a condensing lens that is arranged such that a focal point thereof overlaps a second focal-point of the reflector, and a reflecting member that is arranged between the reflector and the condensing lens and reflects direct light from the light source to the condensing lens.

Actions of the vehicle headlight are explained below. When the light source is turned on, a part of lights from the light source are reflected by the reflector. The reflected lights pass through the second focal-point and gather on the condensing lens to light a place distant from the vehicle as beam lights. Direct light from the light source is reflected by the reflecting member. The reflected light is diffused by the condensing lens to light a place around the front of the vehicle as diffused lights.

However, the vehicle headlight can light a place around the front of the vehicle with the reflecting member but cannot light the left and the right near the vehicle over a wide area.

SUMMARY OF THE INVENTION

It is an object of the present invention to at least solve the problems in the conventional technology.

A vehicle headlight according to one aspect of the present invention includes a main reflector having a main reflection-surface based on an ellipsoid of revolution; a light source that is arranged at a first focal-point of the main reflection-surface or near the first focal-point; a shade that is arranged at a second focal-point of the main reflection-surface or near the second focal-point, cuts off a part of reflected light from the main reflection-surface, and transmits rest of the reflected light, to form a predetermined main light-distribution-pattern; a projection lens that is arranged ahead of the second focal-point and the shade, and projects the main light-distribution-pattern ahead of a vehicle; and a sub reflector that is arranged between the main reflector and the projection lens, and includes a sub reflection-surface that reflects a light from the light source to irradiate the light on outer sides of the main light-distribution-pattern as a predetermined sub-light distribution pattern through the projection lens.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
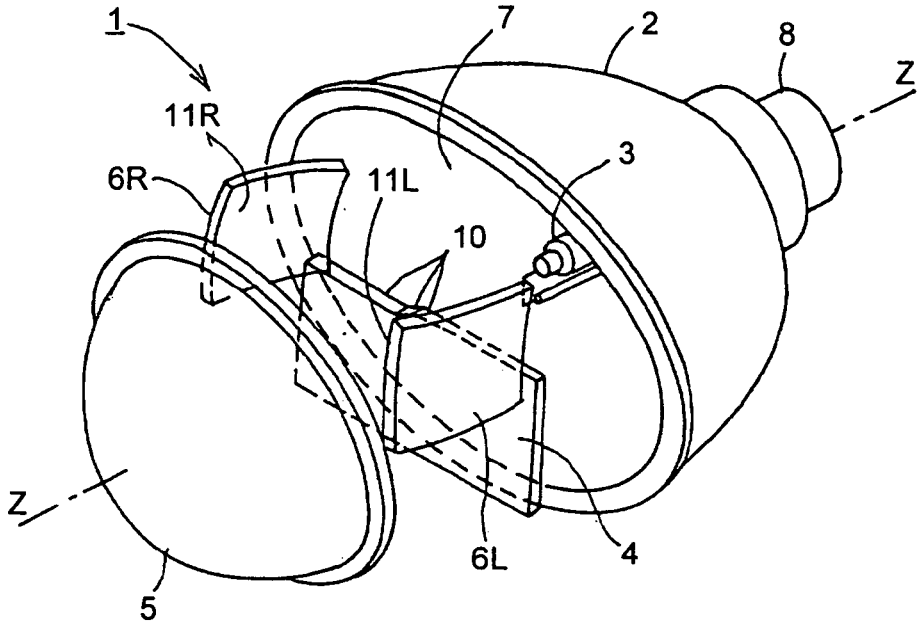
FIG. 1 is a perspective view of a main part of a vehicle headlight according to a first embodiment of the present invention.
Figure 2:
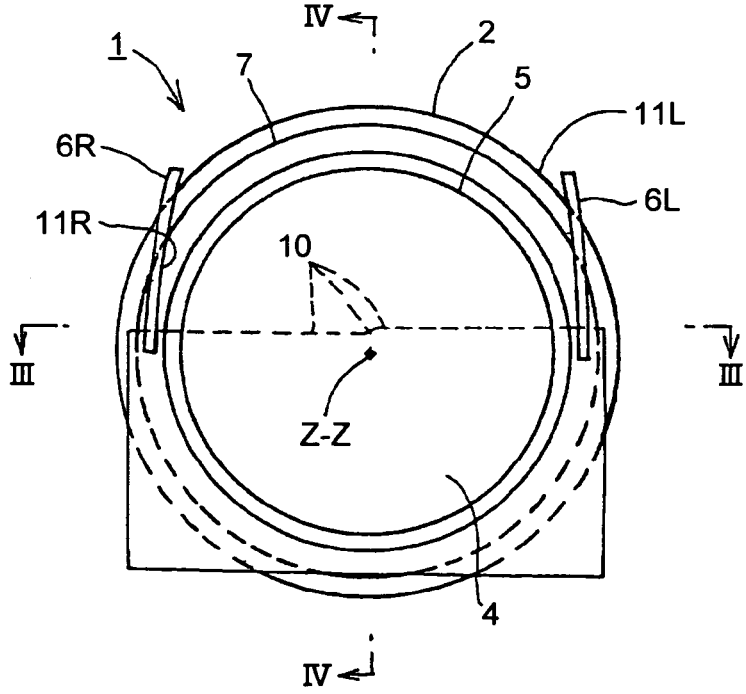
FIG. 2 is a front view of the main part of the vehicle headlight according to the first embodiment.
Figure 3:
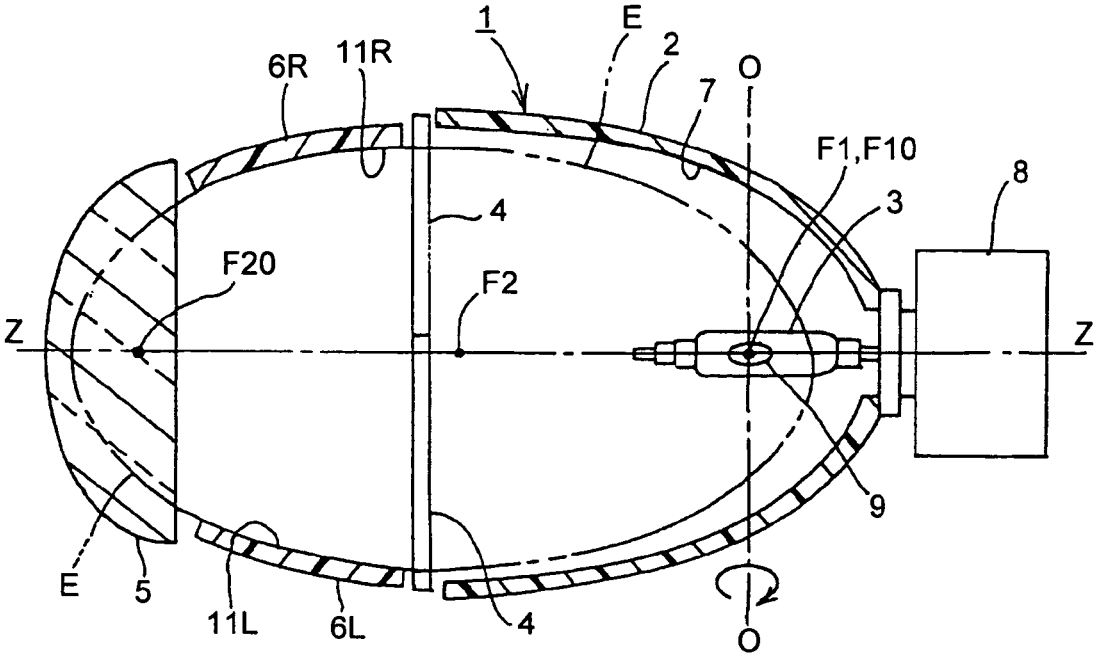
FIG. 3 is a cross section of the main part of the vehicle headlight along a line III-III in FIG. 2.

Exemplary embodiments of the present invention are explained in detail below with reference to the accompanying drawings. Note that the present invention is not limited by the embodiments.

In this specification and claims, "front side" and "front" refer to a front side and a front of a vehicle (a forward traveling-direction side of a vehicle). "Left and right" refer the left and the right sides at the time when the front side is viewed from a driver side. "Upper and lower" refer to the upper and the lower sides viewed from the driver side. In the figures, reference sign "VU-VD" denotes a vertical line from an upper part to a lower part of a screen. Reference sign "HL-HR" denotes a horizontal line from the left to the right of the screen.

In the figures, reference numeral 1 denotes the vehicle headlight according to the first embodiment. The vehicle headlight 1 is a four-lamp system headlamp for low beams of a projector type. The vehicle headlight 1 includes a main reflector 2, a discharge lamp 3 serving as a light source, a shade 4, a projection lens (a condensing lens) 5, and sub reflectors 6L and 6R.

Figure 8:
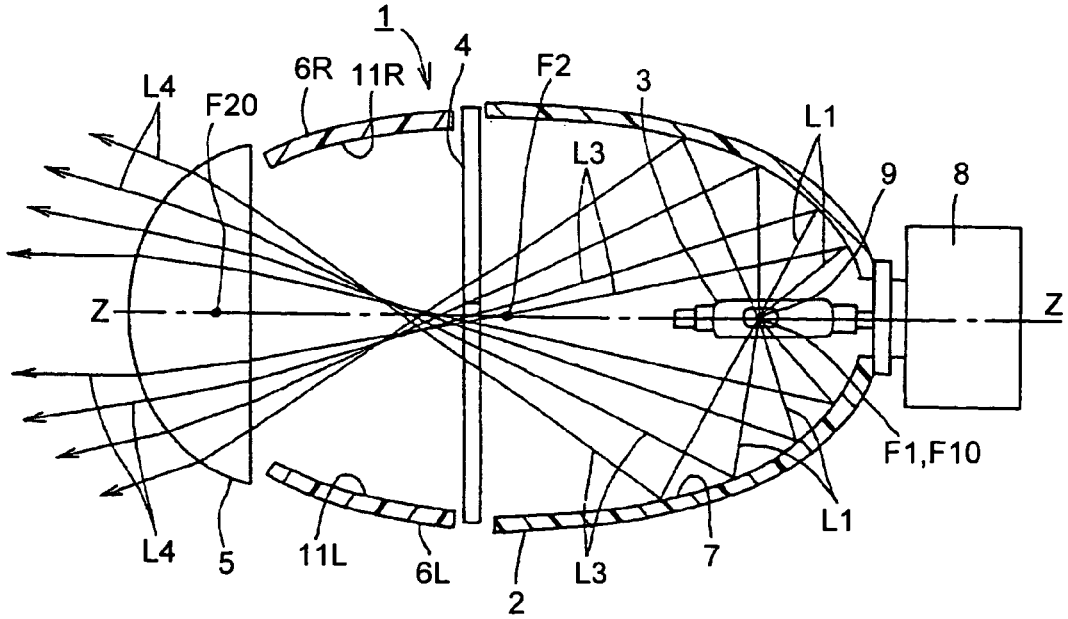
FIG. 8 is a horizontal cross-section of the vehicle headlight for explaining a reflecting action of a main, reflection-surface.
Figure 9:
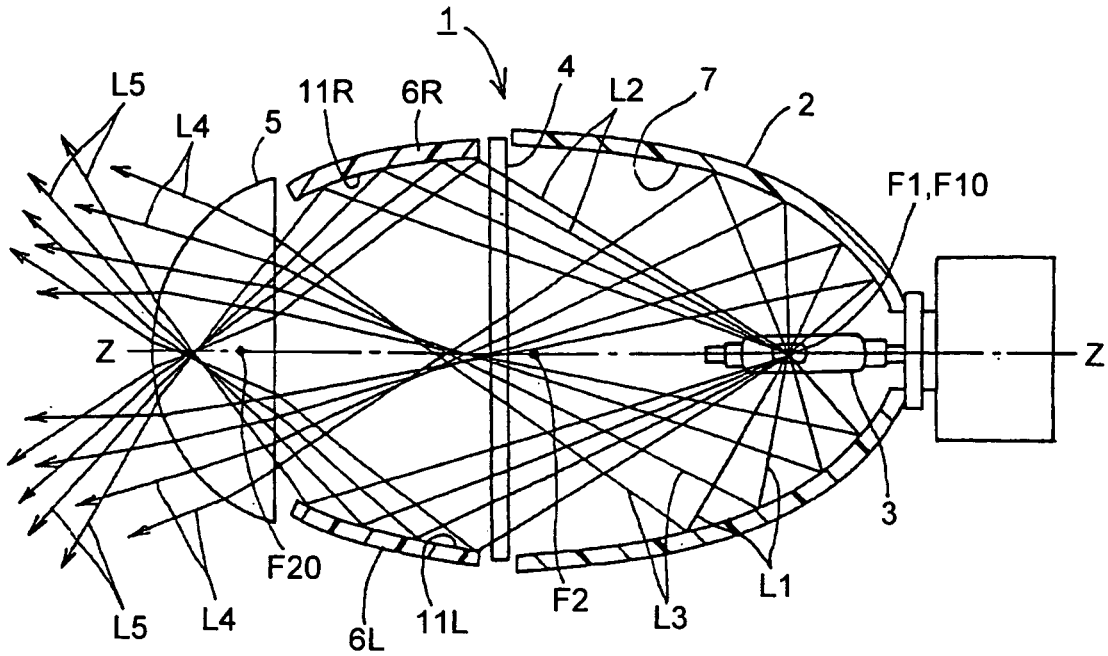
FIG. 9 is a horizontal cross-section of the vehicle headlight for explaining the reflecting action of the left and the right sub reflection-surfaces and the reflecting action of the main reflection-surface.

The main reflector 2 is formed in a shape opened on a front side and closed on a rear side. A through hole piercing through the discharge lamp 3 is provided in the rear center of the main reflector 2. Aluminum deposition or silver coating is applied to an inner concave surface of the main reflector 2. A main reflection-surface 7, which is a free-form surface based on an ellipsoid of revolution, is provided on the inner concave surface of the main reflector 2. The main reflection-surface 7 has a first focal-point F1 and a second focal-point F2. The main reflector 2 is fixed and held on a holder or a frame (not show, hereinafter simply referred to as "holder"). As shown in FIGS. 8 and 9, the main reflection-surface 7 reflects lights L1 that are a part of lights L1 and L2 from the discharge lamp 3 and uses the lights L1 as a predetermined main light-distribution-pattern, for example, a light distribution pattern for low beams MP (see FIG. 10). On the other hand, the lights L2 other than the lights L1 reflected on the main reflection-surface 7 usually become ineffective.

The discharge lamp 3 is a high pressure metal vapor discharge lamp like a so-called metal halide lamp, a high intensity discharge lamp (HID), or the like. The discharge lamp 3 is detachably attached to the main reflector 2 via a socket mechanism 8. A light-emitting section 9 of the discharge lamp 3 is located at the first focal-point F1 of the main reflection-surface 7 of the main reflector 2 or near the first focal-point F1. Note that, as a light source, a tungsten halogen lamp or an incandescent lamp may be used.

The shade 4 is fixed and held on the holder at the second focal-point F2 of the main reflection-surface 7 or near the second focal-point F2. The shade 4 cuts off reflected lights that are a part of reflected lights L3 reflected on the main reflection-surface 7. The shade 4 forms the light distribution pattern for low beams MP using the remaining reflected lights L4. An edge 10 forming cutoff lines CL (see FIG. 10) of the light distribution pattern for low beams MP is provided at an upper edge of the shade 4.

The projection lens 5 is an aspherical lens. A front surface side thereof forms a convex aspheric surface and a rear surface side thereof forms a flat aspheric surface. Although not shown in the figure, the projection lens 5 has a focal plane on an object space side (a meridional image surface) at the second focal-point F2 of the main reflection-surface 7 or near the second focal-point F2. The projection lens 5 is fixed and held on the holder further on the front side than the second focal-point F2 of the main reflection-surface 7 and the shade 4. The projection lens 5 projects the reflected lights L4, which are the reflected lights other than those cut off by the shade 4 of the reflected lights L3 from the main reflection-surface 7, to the outside front as the light distribution pattern for low beams MP. A lens axis of the projection lens 5 substantially coincides with an optical axis Z-Z of the main reflection-surface 7 (a rotation axis or a lamp axis of the ellipsoid of revolution of the main reflection-surface 7).

Figure 7:
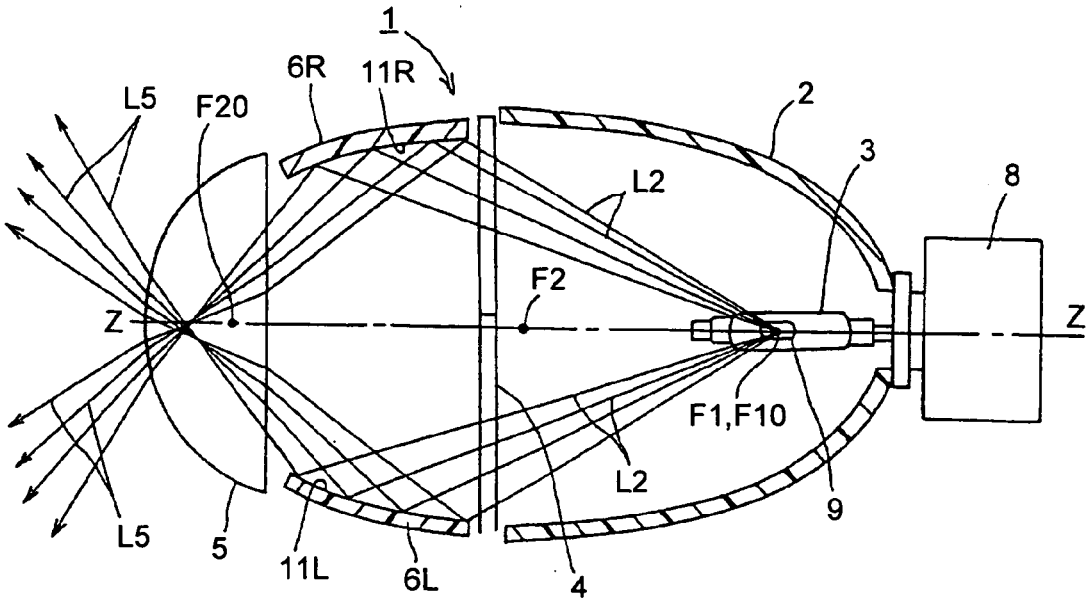
FIG. 7 is a horizontal cross-section of the vehicle headlight for explaining a reflecting action of the left and the right sub reflection-surfaces.

The sub reflectors 6L and 6R are arranged on both the left and right sides between the main reflector 2 and the projection lens 5. The sub reflectors 6L and 6R may also be used as the holder. Sub reflection-surfaces 11L and 11R are provided in the sub reflectors 6L and 6R, respectively. Note that, when the sub reflectors 6L and 6R are also used as the holder, the sub reflection-surfaces 11L and 11R are provided in the holder. The sub reflection-surfaces 11L and 11R are mainly provided further on the front side than the second focal-point F2 of the main reflection-surface 7 (on the projection lens 5 side). As shown in FIGS. 7 and 9, the sub reflection-surfaces 11L and 11R reflect the directly projected lights L2 (the direct lights) from the discharge lamp 3 that usually become ineffective. The sub reflection-surfaces 11L and 11R transmit reflected lights L5 of the directly projected lights L2 through the projection lens 5 and irradiate the reflected lights L5 on the outer side on the left and the right of the light distribution pattern for low beams MP as predetermined sub-light distribution patterns LSP and RSP.

Figure 10:
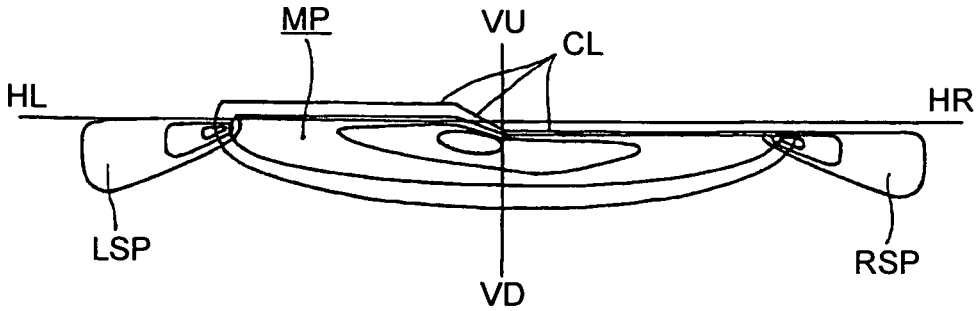
FIG. 10 is a schematic for explaining sub-light distribution patterns obtained by the reflecting action of the left and the right sub reflection-surfaces and a light distribution pattern for low beams obtained by the reflecting action of the main reflection-surface.

As shown in FIG. 10, the sub-light distribution patterns LSP and RSP are wide angle diffused patterns formed in substantially a triangular shape. An upper edge of the sub-light distribution pattern LSP on the left side substantially coincides with the horizontal line HL-HR. An upper edge of the sub-light distribution pattern RSP on the right side substantially coincides with the cut line CL on the right side of the light distribution pattern for low beams MP. Consequently, the vehicle headlight never gives glare to a drive of an oncoming car.

Figure 5:
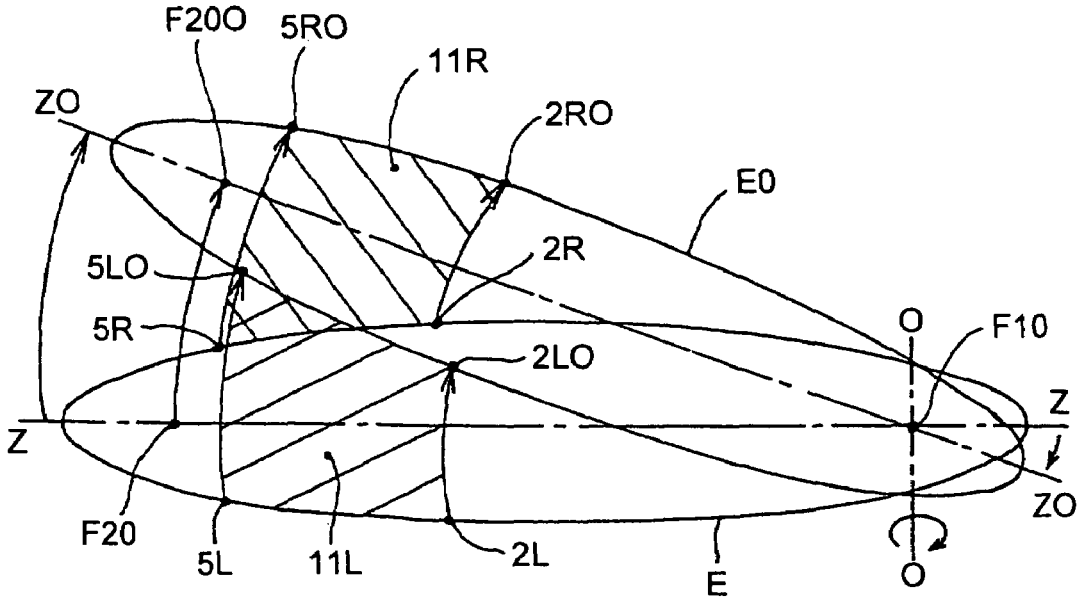
FIG. 5 is a schematic for explaining a structure of left and right sub reflection-surfaces of the vehicle headlight.

A structure of the sub reflection-surfaces 11L and 11R is explained below with reference to FIG. 5. A horizontal sectional shape including the optical axis Z-Z of the sub reflection-surfaces 11L and 11R is a free curve based on an ellipse E. A first focal-point F10 of the sub reflection-surfaces 11L and 11R is located in the light-emitting section 9 of the discharge lamp 3 or near the light-emitting section 9. On the other hand, a second focal-point F20 of the sub reflection-surfaces 11L and 11R is located further on the front side than the flat aspheric surface on the rear surface side of the projection lens 5. In an example shown in the figure, the second focal-point F20 is located on the optical axis Z-Z in the projection lens 5. The free curve is formed by, on the basic ellipse E, a free curve 2L-5L on the left side, which connects a point 2L on the side of the main reflector 2 on the left side and a point 5L on the projection lens 5 side, and a free curve 2R-5R on the right side, which connects a point 2R on the side of the main reflector 2 on the right side and a point 5R on the projection lens 5 side. Note that the second focal-point F20 of the sub reflection-surfaces 11L and 11R may be located further on the front side than the projection lens 5.

Figure 4:
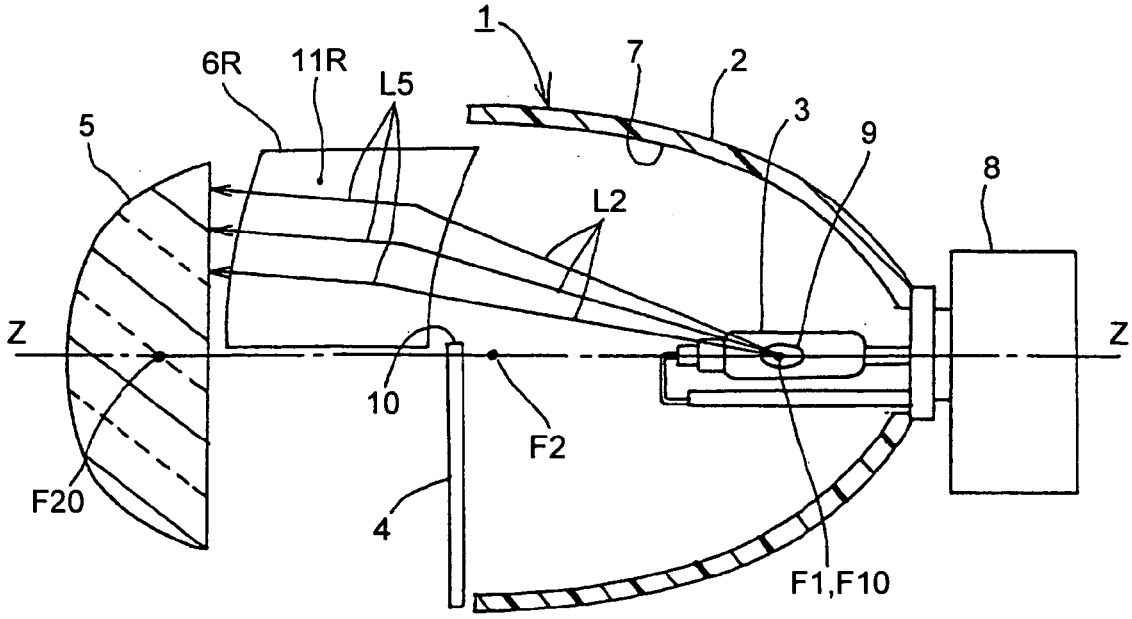
FIG. 4 is a cross section of the main part of the vehicle headlight along a line IV-IV in FIG. 2.

The sub reflection-surfaces 11L and 11R are formed by free-form surfaces based on surfaces obtained by rotating the free curves 2L-5L and 2R-5R around an axis O-O). The axis O-O is substantially orthogonal to the optical axis Z-Z (a major axis of the basic ellipse E) and passes the first focal-point F10 of the sub reflection-surfaces 11L and 11R or near the first focal-point F10. In other words, as shown in FIG. 5, the sub reflection-surfaces 11L and 11R are formed by free-form surfaces (shaded parts in FIG. 5). The free-form surface forming the sub reflection-surface 11L is surrounded by four points, namely, points 2L and 2R on the main reflector 2 side on the basic ellipse E and points 5L and 5R on the projection lens 5 side on the basic ellipse E. The free-form surface forming the sub reflection-surface 11R is surrounded by four points, namely, points 2LO and 2RO on the main reflector 2 side on a basic ellipse EO after the rotation and points 5LO and 5RO on the projection lens 5 side on the basic ellipse EO after the rotation. In this way, the sub reflection-surfaces 11L and 11R are the free-form surfaces formed by rotating the free curves 2L-5L and 2R-5R. Therefore, the reflected lights L5 reflected on the sub reflection-surfaces 11L and 11R travel slightly upward as shown in FIG. 4. Note that, in FIG. 5, reference sign ZO-ZO denotes an optical axis (the major axis of the basic ellipse E) after the rotation and F200 denotes a second focal-point of the sub reflection-surfaces 11L and 11R after the rotation. Therefore, the second focal-point of the sub reflection-surfaces 11L and 11R is located on a curve connecting F20 and F200. Optical axes of the sub reflection-surfaces 11L and 11R are located on a curve connecting Z-Z and ZO-ZO.

The vehicle headlight 1 according to the first embodiment has the structure described above. Actions of the vehicle headlight 1 are explained below.

The discharge lamp 3 is turned on. Then, the lights L1, which are a part of the lights L1 and L2 from the discharge lamp 3, are reflected on the main reflection-surface 7 as shown in FIGS. 8 and 9. The reflected lights L3 of the lights L1 are condensed at the second focal-point F2 of the main reflection-surface 7. A part of the reflected lights L3 to be condensed are cut off by the shade 4. The remaining reflected lights L4 that have not been cut off, that is, the reflected lights L4, which have passed through the shade 4, are diffused and irradiated to the outside front through the projection lens 5. As a result, the light distribution pattern for low beams MP shown in FIG. 10 is obtained.

Figure 6:
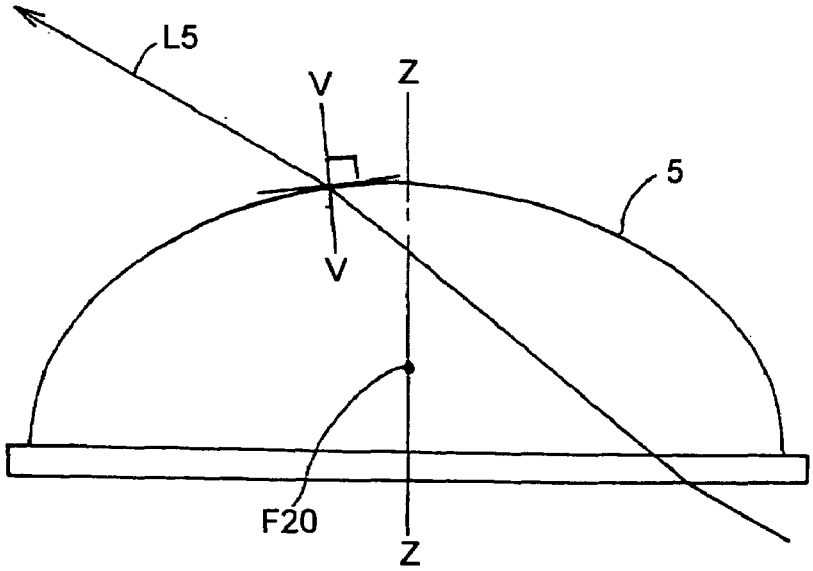
FIG. 6 is a schematic for explaining a state in which reflected light from the sub reflection-surface is transmitted through a projection lens and irradiated on an outer side in the outside front of the vehicle headlight.

At the same time, the lights, which are not reflected on the main reflection-surface 7 and usually become ineffective, of the lights L1 and L2 from the discharge lamp 3, that is, the directly projected lights L2 from the discharge lamp 3 are reflected on the sub reflection-surfaces 11L and 11R as shown in FIGS. 4, 7, and 9. The reflected lights L5 of the directly projected lights L2 travel slightly upward as shown in FIG. 4. As shown in FIGS. 7 and 9, the reflected lights L5 are mainly made incident into the projection lens 5 from the flat aspheric surface of the projection lens 5 further on the front side than the optical axis Z-Z (ZO-ZO) (hereinafter simply referred to as "Z-Z") while being condensed at the second focal-point F20 (F200) (hereinafter simply referred to as "F20") of the sub reflection-surfaces 11L and 11R in the projection lens 5. At this point, most of the reflected lights L5 never cross the optical axis Z-Z at all until the reflected lights L5 are made incident into the projection lens 5. Then, as shown in FIG. 6, the lights L5 made incident into the projection lens 5 exit from the convex aspheric surface of the projection lens 5 to the opposite side of the optical axis Z-Z with respect to a normal V-V on the surface of the projection lens 5. The lights L5 are irradiated at a wide angle to the outer side on the left and the right in the outside front of the projection lens 5. As a result, the sub-light distribution patterns LSP and RSP located on the outer side on the left and the right of the light distribution pattern for low beams MP shown in FIG. 10 are obtained.

The vehicle headlight 1 according to the first embodiment has the structure and the actions described above. Effects of the vehicle headlight 1 are explained below.

The vehicle headlight 1 according to the first embodiment can irradiate the sub-light distribution patterns LSP and RSP on the outer side on the left and the right of the light distribution pattern for low beams MP through the sub reflection-surfaces 11L and 11R as shown in FIG. 10. As a result, the vehicle headlight 1 according to the first embodiment can light the left and the right near the vehicle over a wide area. This can improve visibility at night near the vehicle and contribute to traffic safety.

In particular, in the vehicle headlight 1 according to the first embodiment, the sub reflection-surfaces 11L and 11R are formed as described below. A horizontal sectional shape including the optical axis Z-Z of the sub reflection-surfaces 11L and 11R is a free curve based on the ellipse E. The first focal-point F10 of the sub reflection-surfaces 11L and 11R is located in the light-emitting section 10 of the discharge lamp 3 or near the light-emitting section 10. The second focal-point F20 of the sub reflection-surfaces 11L and 11R is located on the optical axis Z-Z in the projection lens 5. The sub reflection-surfaces 11L and 11R are formed by surfaces obtained by rotating the free curve around the axis O-O. The axis O-O is substantially orthogonal to the optical axis Z-Z and passes the first focal-point F10 of the sub reflection-surfaces 11L and 11R or near the first focal-point F10.

Therefore, in the vehicle headlight 1 according to the first embodiment, the reflected lights L5, which are lights reflected on the sub reflection-surfaces 11L and 11R of the directly projected lights L2 from the discharge lamp 3, are irradiated at a wide angle to the outer side on the left and the right in the outside front through an optical path described below. The reflected lights L5 travel slightly upward and are made incident into the projection lens 5 from the flat aspheric surface of the projection lens 5 further on the front side than the optical axis Z-Z while being condensed at the second focal-point F20 of the sub reflection-surfaces 11L and 11R in the projection lens 5. In other words, the reflected lights L5 never cross the optical axis Z-Z at all until the reflected lights L5 are made incident into the projection lens 5. The lights L5 made incident into the projection lens 5 exit from the convex aspheric surface of the projection lens 5 to the opposite side of the optical axis Z-Z with respect to the normal V-V on the surface of the projection lens 5. The lights L5 are irradiated at a wide angle to the outer side on the left and the right in the outside front.

As a result, in the vehicle headlight 1 according to the first embodiment, the clear sub-light distribution patterns LSP and RSP located on the outer side on the left and the right of the light distribution pattern for low beams MP shown in FIG. 10 are obtained surely.

The vehicle headlight 1 according to the first embodiment transmits the reflected lights L5 from the sub reflection-surfaces 11L and 11R through the projection lens 5. Therefore, it is possible to reduce the vehicle headlight 1 according to the first embodiment in size compared with a vehicle headlight that irradiates reflected lights, which are reflected by sub reflection-surfaces on the left and the right in the outside front, from the outside of a projection lens without transmitting the reflected lights through the projection lens. Moreover, the vehicle headlight 1 according to the first embodiment does not require a member like an inner panel for covering a lamp such that the lamp cannot be seen from the outside of the projection lens. Therefore, manufacturing cost is reduced.

The vehicle headlight 1 according to the first embodiment can effectively use the directly projected lights L2 from the discharge lamp 3 that usually become ineffective. Moreover, in the vehicle headlight 1 according to the first embodiment, since an amount of light irradiated to the outside front increases, efficiency of light irradiation is increased and an amount of heat filled inside the vehicle headlight 1 decreases.

Furthermore, in the vehicle headlight 1 according to the first embodiment, the sub reflectors 6L and 6R forming the sub reflection-surfaces 11L and 11R can also be used as the holder that holds the shade 4 of the main reflector 2 and the projection lens 5. Consequently, a size and a weight of the vehicle headlight 1 according to the first embodiment can be reduced and the number of components can also be reduced. Therefore, it is possible to reduce manufacturing cost.

Figure 11:
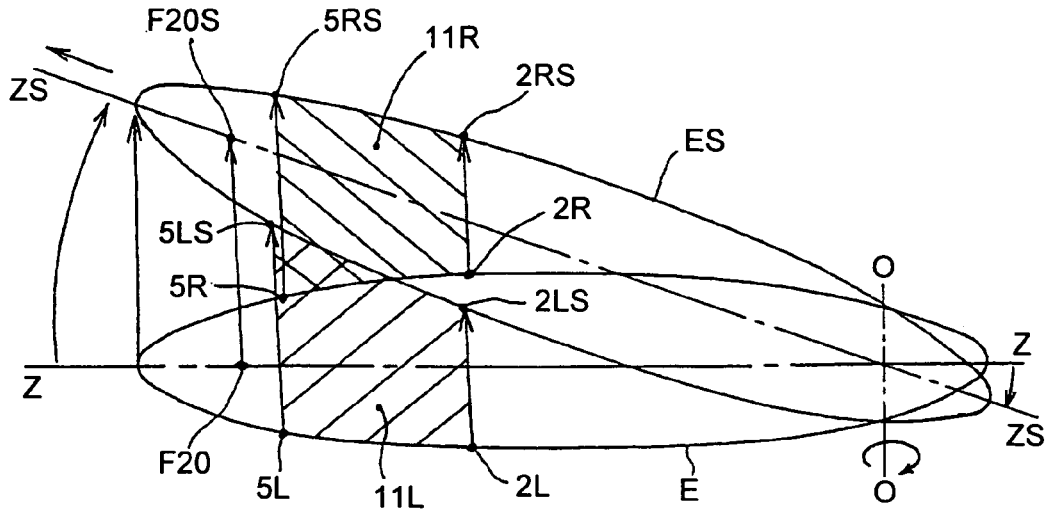
FIG. 11 is a schematic for explaining a structure of left and right sub reflection-surfaces of a vehicle headlight according to a second embodiment of the present invention.

FIG. 11 is a schematic for explaining a sub reflection-surface of a vehicle headlight in a second embodiment of the present invention. In the figure, reference numerals and signs identical with those in FIGS. 1 to 10 denote the identical components.

In the vehicle headlight according to the second embodiment, the sub reflection-surfaces 11L and 11R are formed as described below. A horizontal sectional shape including the optical axis Z-Z of the sub reflection-surfaces 11L and 11R is a free curve based on the ellipse E. The first focal-point F10 of the sub reflection-surfaces 11L and 11R is located in the light-emitting section 9 of the discharge lamp 3 or near the light-emitting section 9. On the other hand, the second focal-point F20 of the sub reflection-surfaces 11L and 11R is located further on the front side than the flat aspheric surface on the rear surface side of the projection lens 5. In an example shown in the figure, the second focal-point F20 is located on the optical axis Z-Z in the projection lens 5. The free curve is formed by, on the basic ellipse E, the free curve 2L-5L on the left side, which connects the point 2L on the side of the main reflector 2 on the left side and the point 5L on the projection lens 5 side, and the free curve 2R-5R on the right side, which connects the point 2R on the side of the main reflector 2 on the right side and the point 5R on the projection lens 5 side. Note that the second focal-point F20 of the sub reflection-surfaces 11L and 11R may be located further on the front side than the projection lens 5.

The sub reflection-surfaces 11L and 11R are formed by free-form surfaces based on surfaces obtained by gradually changing the major axis of the basic ellipse E (the optical axis Z-Z) such that the second focal-point F20 of the sub reflection-surfaces 11L and 11R is located substantially on a vertical line with respect to the horizontal section while rotating the free curves 2L-5L and 2R-5R around the axis O-O. The axis O-O is substantially orthogonal to the optical axis Z-Z (the major axis of the basic ellipse E) and passes through the first focal-point F10 of the sub reflection-surfaces 11L and 11R or near the first focal-point F10.

In other words, the sub reflection-surfaces 11L and 11R are formed by free-form surfaces obtained by continuously connecting the free curves 2L-5L and 2R-5R and curves 2LS-5LS and 2RS-5RS. The curves 2LS-5LS and 2RS-5RS are obtained by projecting the free curves 2L-5L and 2R-5R on a plane, which is formed by rotating the free curves 2L-5L and 2R-5R around the axis O-O substantially vertically with respect to the horizontal section. The axis O-O is substantially orthogonal to the optical axis Z-Z (the major axis of the basic ellipse E) and passes the first focal-point F10 of the sub reflection-surfaces 11L and 11R or near the first focal-point F10.

As shown in FIG. 11, the sub reflection-surfaces 11L and 11R are formed by free-form surfaces (shaded parts in FIG. 11). The free-form surface forming the sub reflection-surface 11L is surrounded by four points, namely, the points 2L and 2R on the main reflector 2 side on the basic ellipse E and the points 5L and 5R on the projection lens 5 side on the basic ellipse E. The free-form surface forming the sub reflection-surface 11R is surrounded by four points, namely, points 2LS and 2RS on the main reflector 2 side on a basic ellipse ES after the rotation and gradual change and points 5LS and 5RS on the projection lens 5 side on the basic ellipse ES after the rotation and gradual change. Note that, in FIG. 11, reference sign ZS-ZS denotes an optical axis (the major axis of the basic ellipse E) after the rotation and gradual change and F20S denotes a second focal-point of the sub reflection-surfaces 11L and 11R after the rotation and gradual change. Therefore, the second focal-point of the sub reflection-surfaces 11L and 11R is located on a straight line connecting F20 and F20S. Optical axes of the sub reflection-surfaces 11L and 11R are located on a straight line connecting Z-Z and ZS-ZS.

The vehicle headlight according to the second embodiment can attain substantially the same operational effects as the vehicle headlight 1 according to the first embodiment.

Figure 12:
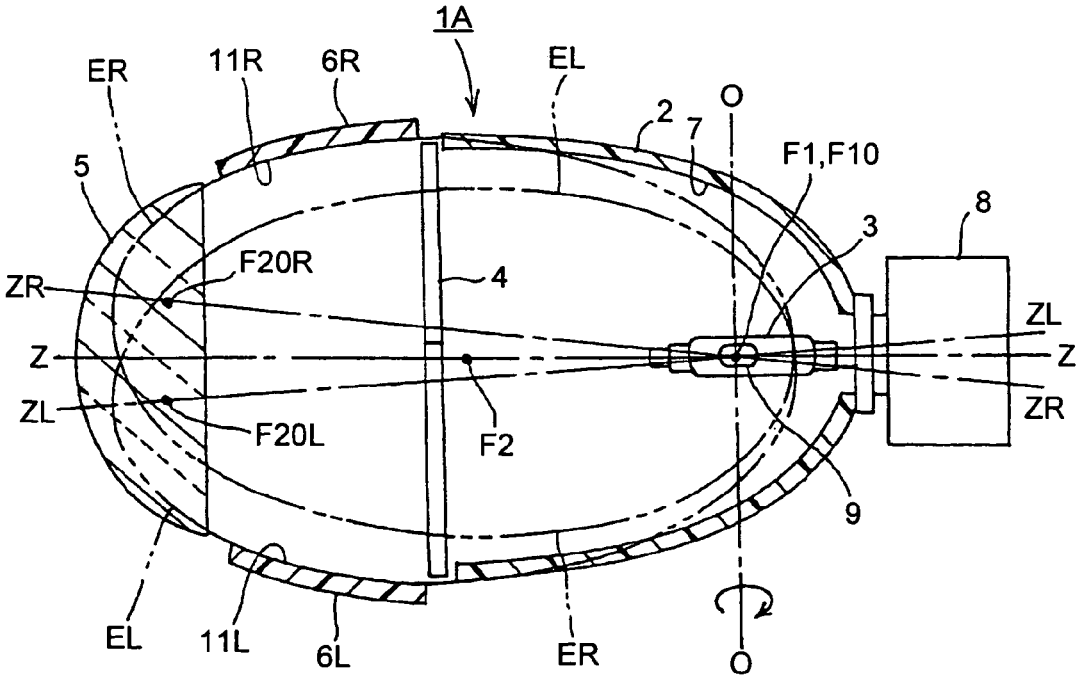
FIG. 12 is a horizontal cross-section of a vehicle headlight according to a third embodiment of the present invention.

FIG. 12 is a horizontal cross-section of a vehicle headlight according to a third embodiment of the present invention. In the figure, reference numerals and signs identical with those in FIGS. 1 to 11 denote the identical components.

In a vehicle headlight 1A according to the third embodiment, a basic ellipse of a free curve forming a horizontal sectional shape including the optical axis Z-Z of the left and the right sub reflection-surfaces 11L and 11R is divided into left and right basic ellipses EL and ER. A second focal-point F20L of the sub reflection-surface 11L on the left side is located further on the side of the sub reflection-surface 11L on the left side than the optical axis Z-Z of the main reflection-surface 7 in the projection lens 5. On the other hand, a second focal-point F20R of the sub reflection-surface 11R on the right side is located further on the side of the sub reflection-surface 11R on the right side than the optical axis Z-Z of the main reflection-surface 7 in the projection lens 5. As a result, a major axis of the basic ellipse EL forming the sub reflection-surface 11L on the left side (an optical axis ZL-ZL of the sub reflection-surface 11L on the left side) is located further on the side of the sub reflection-surface 11L on the left side than the optical axis Z-Z of the main reflection-surface 7. On the other hand, a major axis of the basic ellipse ER forming the sub reflection-surface 11R on the right side (an optical axis ZR-ZR of the sub reflection-surface 11R on the right side) is located further on the side of the sub reflection-surface 11R on the right side than the optical axis Z-Z of the main reflection-surface 7.

The vehicle headlight 1A according to the third embodiment can attain substantially the same operational effects as the vehicle headlight 1 according to the first embodiment and the vehicle headlight according to the second embodiment.

In particular, in the vehicle headlight 1A according to the third embodiment, it is possible to form the left and the right sub reflection-surfaces 11L and 11R separately. Thus, it is possible to control the left and the right sub-light distribution patterns LSP and RSP obtained on the left and the right sub reflection-surfaces 11L and 11R separately. Therefore, freedom of light distribution design is improved.

According to the present invention, the following four types of headlights for vehicles are obtained. In a first type, the left and the right sub reflection-surfaces 11L and 11R are formed by rotating the basic ellipse E common to the left and the right of the vehicle headlight as in the vehicle headlight according to the first embodiment. In a second type, the left and the right sub reflection-surfaces 11L and 11R are formed by rotating and gradually changing the basic ellipse E common to the left and the right of the vehicle headlight as in the vehicle headlight according to the second embodiment. In a third type, the left and the right sub reflection-surfaces 11L and 11R are formed by rotating the basis ellipses EL and ER separate for the left and the right of the vehicle headlight as in the vehicle headlight 1 according to the first embodiment and the vehicle headlight 1A according to the third embodiment. In a fourth type, the left and the right sub reflection-surfaces 11L and 11R are formed by rotating and gradually changing the basic ellipses EL and ER separate for the left and the right of the vehicle headlight as in the vehicle headlight according to the second embodiment and the vehicle headlight 1A according to the third embodiment.

According to the first to the third embodiments, the headlights for vehicles, in which the light distribution pattern for low beams is obtained, have been explained. However, it is also possible to apply the present invention to a vehicle headlight such as a fog lamp in which a light distribution pattern for fog is obtained as a predetermined main light-distribution-pattern.

In the explanation in this specification and the drawings, a vehicle runs on the left side of a road. When a vehicle runs on the right side of a road, the left and the right of the cutoff lines CL of the light distribution pattern for low beams MP, the edge 10 of the shade 4, and the like are reversed.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle headlight comprising:

a main reflector having a main reflection-surface based on an ellipsoid of revolution;

a light source that is arranged at a first main focal-point of the main reflection-surface or near the main first focal-point;

a shade that is arranged at a second main focal-point of the main reflection-surface or near the second main focal-point, cuts off a part of reflected light from the main reflection-surface, and transmits the rest of the reflected light, to form a predetermined main light-distribution-pattern;

a projection lens that is arranged ahead of the second main focal-point and the shade, and projects the main light-distribution-pattern ahead of a vehicle;

a sub reflector arranged between the main reflector and the projection lens; and a sub reflection-surface that is provided in the sub reflector, and reflects a light from the light source to irradiate the light on outer sides of the main light-distribution-pattern as a predetermined sub-light distribution pattern through the projection lens, wherein a first sub focal-point of the sub reflection-surface is located at the light source or near the light source, wherein a second sub focal-point of the sub reflection-surface is located in front of the second main focal-point.

2. The vehicle headlight according to claim 1, wherein a shape of a horizontal cross-section of the sub reflection-surface including an optical axis is a free curve based on an ellipse, the second sub focal-point of the sub reflection-surface is located on the optical axis or on a side closer to the sub reflection-surface than the optical axis in the projection lens, and the sub reflection-surface is formed by a surface obtained by rotating the free curve around an axis that is substantially orthogonal to the optical axis and passes the first sub focal-point or near the first sub focal-point.

3. The vehicle headlight according to claim 1, wherein a shape of a horizontal cross-section of the sub reflection-surface including an optical axis is a free curve based on an ellipse, the second sub focal-point of the sub reflection-surface is located on the optical axis or on a side closer to the sub reflection-surface than the optical axis in the projection lens, and the sub reflection-surface is formed by a surface obtained by gradually changing a major axis of the ellipse in such a manner that the second sub focal-point is located substantially on a perpendicular line with respect to the horizontal cross-section while rotating the free curve around an axis that is substantially orthogonal to the optical axis and passes the sub first focal-point or near the first sub focal-point.

4. The vehicle headlight according to claim 1, wherein the sub reflector includes a left-side sub reflector and a right-side sub reflector, the sub reflection-surface is formed by a left-side sub reflection-surface provided on the left-side sub reflector and a right-side sub reflection-surface provided on the right-side sub reflector, reflected light from the left-side sub reflection-surface and the right-side sub reflection-surface travels slightly upward and is incident into the projection lens further on a front side than an optical axis of the sub reflection-surface, and the reflected light incident into the projection lens exits to an opposite side of the optical axis with respect to a normal to a lens surface from the projection lens.

5. The vehicle headlight according to claim 1, wherein the sub reflector includes a left-side sub reflector and a right-side sub reflector, the sub reflection-surface is formed by a left-side sub reflection-surface provided on the left-side sub reflector and a right-side sub reflection-surface provided on the right-side sub reflector, a shape of a horizontal cross-section of the left-side sub reflection-surface and the right-side sub reflection-surface, including an optical axis, is a free curve based on an ellipse, wherein the first sub focal-point is a sub focal-point of the left-side sub reflection-surface and the right-side sub reflection-surface, wherein the second sub focal-point is a sub focal-point of the left-side sub reflection-surface and the right-side sub reflection-surface and is located on the optical axis in the projection lens, and the left-side sub reflection-surface and the right-side sub reflection-surface are formed by a surface obtained by rotating the free curve around an axis that is substantially orthogonal to the optical axis and passes through the first sub focal-point or near the first sub focal-point.

6. The vehicle headlight according to claim 1, wherein the sub reflector includes a left-side sub reflector and a right-side sub reflector, the sub reflection-surface is formed by a left-side sub reflection-surface provided on the left-side sub reflector and a right-side sub reflection-surface provided on the right-side sub reflector, a shape of a horizontal cross-section of the left-side sub reflection-surface and the right-side sub reflection-surface, including an optical axis, is a free curve based on an ellipse, wherein the first sub focal-point is a sub focal-point of the left-side sub reflection-surface and the right-side sub reflection-surface and is located at the light source or near the light source, wherein the second sub focal-point is a sub focal-point of the left-side sub reflection-surface and the right-side sub reflection-surface and is located on a side closer to the left-side sub reflection-surface and the right-side sub reflection-surface than the optical axis in the projection lens, and the left-side sub reflection-surface and the right-side sub reflection-surface are formed by a surface obtained by rotating the free curve around an axis that is substantially orthogonal to the optical axis and passes through the first sub focal-point or near the first sub focal-point.

7. The vehicle headlight according to claim 1, wherein the sub reflector includes a left-side sub reflector and a right-side sub reflector, the sub reflection-surface is formed by a left-side sub reflection-surface provided on the left-side sub reflector and a right-side sub reflection-surface provided on the right-side sub reflector, a shape of a horizontal cross-section of the left-side sub reflection-surface and the right-side sub reflection-surface, including an optical axis, is a free curve based on an ellipse, wherein the first sub focal-point is a sub focal-point of the left-side sub reflection-surface and the right-side sub reflection-surface and is located at the light source or near the light source, wherein the second sub focal-point is a sub focal-point of the left-side sub reflection-surface and the right-side sub reflection-surface and is located on the optical axis in the projection lens, and the left-side sub reflection-surface and the right-side sub reflection-surface are formed by a surface obtained by gradually changing a major axis of the basic ellipse in such a manner that the second sub focal-point is located substantially on a perpendicular line with respect to the horizontal cross-section while rotating the free curve around an axis that is substantially orthogonal to the optical axis and passes through the sub first focal-point or near the first sub focal-point.

8. The vehicle headlight according to claim 1, wherein the sub reflector includes a left-side sub reflector and a right-side sub reflector, the sub reflection-surface is formed by a left-side sub reflection-surface provided on the left-side sub reflector and a right-side sub reflection-surface provided on the right-side sub reflector, a shape of a horizontal cross-section of the left-side sub reflection-surface and the right-side sub reflection-surface, including an optical axis, is a free curve based on an ellipse, wherein the first sub focal-point is a sub focal-point of the left-side sub reflection-surface and the right-side sub reflection-surface and is located at the light source or near the light source, wherein the second sub focal-point is a sub focal-point of the left-side sub reflection-surface and the right-side sub reflection-surface and is located on a side closer to the left-side sub reflection-surface and the right-side sub reflection-surface than the optical axis in the projection lens, and the left-side sub reflection-surface and the right-side sub reflection-surface are formed by a surface obtained by gradually changing a major axis of the basic ellipse in such a manner that the second sub focal-point is located substantially on a perpendicular line with respect to the horizontal cross-section while rotating the free curve around an axis that is substantially orthogonal to the optical axis and passes through the sub first focal-point or near the first sub focal-point.

9. The vehicle headlight according to claim 1, wherein the sub reflector includes a holder that holds the main reflector, the shade, and the projection lens.

10. The vehicle headlight according to claim 1, wherein the sub reflection-surface is arranged such that reflected light from the sub reflection-surface travels slightly upward and is incident into the projection lens relative to an optical axis of the sub reflection-surface.

11. The vehicle headlight according to claim 1, wherein the second sub focal-point is located in the projection lens.

* * * * *